United States Patent [19]

Kowalski

[11] 4,451,081

[45] May 29, 1984

[54] HEADREST FOR A RECLINING CHAIR

[75] Inventor: Jerome R. Kowalski, Tupelo, Miss.

[73] Assignee: Mohasco Corporation, Amsterdam, N.Y.

[21] Appl. No.: 337,465

[22] Filed: Jan. 6, 1982

[51] Int. Cl.[3] ..... A47C 1/02

[52] U.S. Cl. ..... 297/61; 297/404

[58] Field of Search ..... 297/61, 410, 404

[56] References Cited

U.S. PATENT DOCUMENTS

| | | | |
|---|---|---|---|
| 2,973,029 | 2/1961 | Schlosstein | 297/404 X |
| 3,065,029 | 11/1962 | Spound et al. | 297/61 X |
| 3,652,129 | 3/1972 | Rogers | 297/61 |
| 3,836,198 | 9/1974 | Mizelle | 297/61 X |
| 3,871,704 | 3/1975 | Shoemaker et al. | 297/61 |
| 4,353,595 | 10/1982 | Kaneko et al. | 297/61 X |
| 4,362,336 | 12/1982 | Zapf et al. | 297/61 X |

*Primary Examiner*—James T. McCall

*Attorney, Agent, or Firm*—Kirschstein, Kirschstein, Ottinger & Israel

[57] ABSTRACT

A headrest arrangement to be mounted on a backrest of a chair, especially a wall-proximity reclining chair, includes a support consisting of two support members which are articulately connected to one another, and a kinematic linkage which mounts the support on the backrest for movement between a retracted and an extended position. The headrest arrangement further includes a cushion member which is affixed to the upper one of the support members, and a connecting link which connects the upper support member to the kinematic linkage and causes the upper support member to conduct angular movement relative to the lower support member which is mounted on the kinematic linkage, during and in dependence on the movement of the kinematic linkage. In the retracted position, the support members form continuations of one another and extend across the open end of a recess in the backrest which accommodates the cushion member and the kinematic linkage. In the extended position, the support members are so inclined relative to one another that the upper support member extends to above the backrest and the cushion member extends frontwardly beyond the backrest. The connecting link has a variable length and is urged by a spring to its position of shortest length. The spring force can be overcome by the head of the user resting on the cushion member, to give additional comfort.

20 Claims, 6 Drawing Figures

HEADREST FOR A RECLINING CHAIR

BACKGROUND OF THE INVENTION

The present invention relates to headrest arrangements for use on backrests of chairs in general, and more particularly to a headrest arrangement of a reclining chair, especially of a wall-proximity reclining chair.

There are already known various constructions of headrests for reclining chairs, among them such which can be fully concealed within the backrest in their retracted position and moved into their extended position in which the user of the chair can rest his or her head thereon. Such constructions are disclosed for instance, in U.S. Pat. Nos. 2,975,826, 2,996,332, 3,813,151 3,871,704 and 3,937,518. In such conventional constructions, the headrest is movable between its retracted and extended positions either independently, or in dependence on the movement of the backrest between its substantially upright position, and its fully reclined position, through at least one partially reclined position.

One of the drawbacks which is overcome by these conventional constructions is the elimination of a need for a separate cushion to be used by the user of the reclining chair at least in some of the positions of the backrest. It will be appreciated that the need for using such separate cushion which existed prior to the development of headrests mounted on the backrests of reclining chairs was bound to cause the user of the chair many inconveniences. So, for instance, the user of the chair would have to ascertain the whereabouts of the separate cushion prior to the intended use thereof, and then properly position the same on the backrest for the intended use. Since this separate cushion may be just about anywhere at this time, such as underneath or behind the lower back of the user already sitting in the chair, or on the floor next to, underneath or even behind the chair, the user is greatly inconvenienced by this search for the separate cushion and the body movements needed for reaching and/or moving the cushion. Making the cushion a permanent part of the backrest would constitute only an imperfect solution since, while eliminating the need for searching for and manipulating the cushion, it would make the use of the cushion mandatory, whether or not desired by the user. This is one of the reasons why the conventional movable headrests have been developed.

However, such conventional headrest arrangements are also possessed of certain disadvantages. So, for instance, when the headrest is movable independently of the movement of the backrest, a separate series of manipulating steps is required every time the headrest is to be used, or its use is to be discontinued. In many instances, the user has to leave the chair in order to move the headrest between its extended and retracted positions. On the other hand, when the headrest is moved between its retracted and extended position either by the user while still occupying the chair, or in dependence on the reclining movement of the backrest, the headrest arrangement of the conventional constructions includes a complicated operating mechanism which mounts the headrest proper on the backrest for movement relative thereto between its extended and retracted positions. In the conventional constructions of the headrest mounting and operating mechanism, a considerable amount of available space must be present behind the chair and behind the path of movement of the reclinable backrest to permit the headrest to conduct its movement between the retracted and the extended position. This problem is further aggravated by the fact that it is often desired to fully conceal the headrest and its operating mechanism within the confines of the backrest when the headrest is in its retracted position, and to let the cushion of the headrest project by a certain distance frontwardly beyond the backrest in the extended position. In the conventional headrest arrangements capable of satisfying, at least to some extent, these conditions, the operating and mounting mechanism for the headrest is complex and unwieldy, presents an aesthetically unappealing view in its extended position, and yet still requires a considerable amount of available space behind the chair. This, of course, is very disadvantageous not only when the chair is to be used in small rooms where space is at a premium, but also in other uses, since it is very rare indeed that a chair situated at a considerable distance from a wall presents an aesthetically pleasing appearance, regardless of the appearance of the chair as such.

SUMMARY OF THE INVENTION

Accordingly, it is a general object of the present invention to avoid the disadvantages of the prior art.

More particularly, it is an object of the present invention to develop a chair, particularly a reclining chair, equipped with a headrest arrangement which is not possessed of the disadvantages of the conventional headrest arrangements.

Still another object of the present invention is to so construct the headrest arrangement of the type here under consideration as to require only a minimum amount of available space behind the chair, and not to present an aesthetically unappealing appearance in any of its positions relative to the backrest.

It is yet another object of the invention to so design the headrest arrangement as to provide a high degree of comfort to the user thereof, including limited yieldability in its extended position.

A concomitant object of the present invention is to provide a headrest and a mounting and operating mechanism therefor which are simple in construction, inexpensive to manufacture, easy to operate, and reliable nevertheless.

In pursuance of these objects and others which will become apparent hereafter, one feature of the present invention resides in a headrest arrangement for use on a backrest of a chair, particularly of a reclining chair, which headrest arrangement comprises a support including a first and a second support member articulately connected to one another for angular displacement relative to each other about an axis disposed therebetween; a cushion member secured at least to the first support member and projecting in a predetermined direction therefrom; means for so mounting the support on the backrest that the first support member is situated upwardly of the second support member and the axis extends substantially horizontally, for movement between a retracted position in which the support and cushion members are situated in the back of the backrest and an extended position in which at least the first support member extends upwardly of the backrest and the cushion member projects frontwardly above the backrest and beyond the same; and means for angularly displacing the first support member relative to the second support member during the movement of the support relative to the backrest between the retracted and the extended positions thereof.

A particular advantage of this construction of the headrest arrangement is that, because of the bipartite construction of the support of the headrest and the articulated connection therebetween, the support can move much closer to the backrest than heretofore possible. Moreover, for the same reason, the mechanism which mounts and operates the headrest proper does not project as obstrusively as the conventional mechanisms rearwardly from the backrest in the extended position or in any intermediate position of the headrest, and yet the cushion member can assume a position in which it projects as much as, or even more than, the cushion members of the conventional headrest arrangements beyond the backrest in its extended position, to provide an improved comfort for the user of the chair.

A particularly simple and otherwise advantageous construction of the headrest arrangement of the present invention is obtained when the mounting means includes at least one kinematic linkage which mounts the second support member on the backrest, and when the angularly displacing means includes at least one connecting link articulated to the kinematic linkage and to the first support member. Advantageously, the first support member includes a main element and at least one bracket secured to the main element and projecting in the predetermined direction therefrom, the connecting link being articulately mounted on the bracket. Then, the kinematic linkage advantageously includes at least two mounting links which extend between the backrest and the second support member, and the connecting link is articulately mounted on one of the mounting links. It is particularly advantageous when the mounting link on which the connecting link is mounted is more remote from the first support member than the other mounting link.

The above-discussed construction of the mounting and operating part of the headrest arrangement has the advantage of great simplicity and yet excellent reliability. While, in theory, the mounting and operating part of the headrest arrangement could include only one such kinematic linkage and the associated components, in practical applications the mounting means will include a pair of such kinematic linkages with associated components, each arranged at one lateral portion of the backrest.

When the headrest arrangement is to be used on a backrest having a recess for accommodating the cushion member in the retracted position of the support and at least a part of the kinematic linkage, or each of the kinematic linkages, at all times it is particularly advantageous when the kinematic linkage, the support members and the connecting link are so constructed that the support members extend, in continuation of one another, across the open end of the recess to conceal the same and the contents thereof, in the retracted position. Then, especially when the chair is a wall-proximity reclining chair, the support and cushion members, the kinematic linkage, and the connecting link are so constructed that the support members move in close proximity of the back side of the backrest during their movement between the retracted and extended positions.

In accordance with a currently preferred aspect of the present invention, the mounting links of the kinematic linkage have different effective lengths, that is, the lengths as measured between their pivoting axes. Advantageously, the kinematic linkage is a four-bar linkage in which the mounting links extend substantially parallel to one another in all positions of the support, the linkage being completed by a support link rigid with or otherwise mounted on the backrest, and by the second support member.

In order to assure that the range of motion of the headrest arrangement is limited to movement between the retracted and extended positions, there is provided a stop member on the other of the mounting links, and an abutment surface on the bracket against which the stop member abuts in the retracted position of the support. Then, an additional abutment surface is advantageously provided on the connecting link which comes into contact with the stop member in the extended position of the support.

The headrest arrangement as described so far may be so constructed that there is no leeway in the construction, that is, that the position of the first support member relative to the second support member is always predetermined by the position of the second support member relative to the backrest. However, it is desirable, under certain circumstances, to be able to change the relative angular positions of the first and second support members, for instance, for enabling the first support member to yield as the cushion member exits from or enters the recess in the backrest. Thus, in accordance with a further concept of the invention, there is further provided means for changing the effective length of the connecting link, that is, the distance between the articulation axes of the connecting link. By adjusting the effective length of the connecting link, the relative angular position of the support member is varied to the desired extent.

While it would be possible to so construct the connecting link that the effective length thereof would be fixed after each adjustment, it is currently preferred to provide the connecting link with a capability of changing its effective length in response to the application of forces to the first support member, either directly or via the cushion member. To achieve this possibility, the connecting link advantageously includes two elongated parts which partially overlap each other, the changing means then including means for mounting the parts of the connecting link on one another for movement relative to each other longitudinally thereof between two end positions, and means for urging the parts of the connecting link to one of the end positions thereof. A particularly simple and otherwise advantageous construction is obtained when the means for mounting the parts of the connecting link on one another includes an elongated slot in one of the parts, and at least one projection on the other of the parts, this projection being received in the slot of the one part for movement longitudinally of the slot.

In a particularly advantageous embodiment of this concept of the present invention, the projection has a stem received in the slot, and a head enlarged relative to the stem and to the slot and situated at the other side of the one part from the other part of the connecting link to prevent extraction of the stem from the slot. The means for mounting the parts of the connecting link on one another advantageously further includes another projection similar to the aforementioned projection of the other part of the connecting link, this other projection being spaced from the initially mentioned projection in the longitudinal direction of the other part of the connecting link and thus of the slot of the one part of the connecting link, this other projection thus being operative, in cooperation with the initially mentioned projection, to restrict the movement of the parts of the connecting link relative to one another to movement longitudinally of the slot.

The urging means forming a part of the means for changing the effective length of the connecting link advantageously includes at least one spring, especially a helical tension spring, which is connected to the one part of the connecting link at one of its ends and to the other part of the connecting link at its other end, the spring being operative for urging the parts of the connecting link to that of the end positions thereof in which the effective length of the connecting link is the shortest. The spring is advantageously pre-tensioned to hold the parts of the connecting link in the one end position thereof, the pre-tensioning force of the spring being advantageously such that the cushion and first support members will yield only when the pressure exerted thereon, especially by the head of the user of the chair, exceeds a preset value. This yieldability of the cushion when the head of the user rests thereon gives the user an improved feeling of comfort. Moreover, this yieldability also permits the support member and the cushion member mounted thereon to easily clear any obstructions which may be present in the path of movement thereof while moving between the extended and retracted positions.

The novel features which are considered as character istic of the invention are set forth in particular in the appended claims. The improved headrest arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
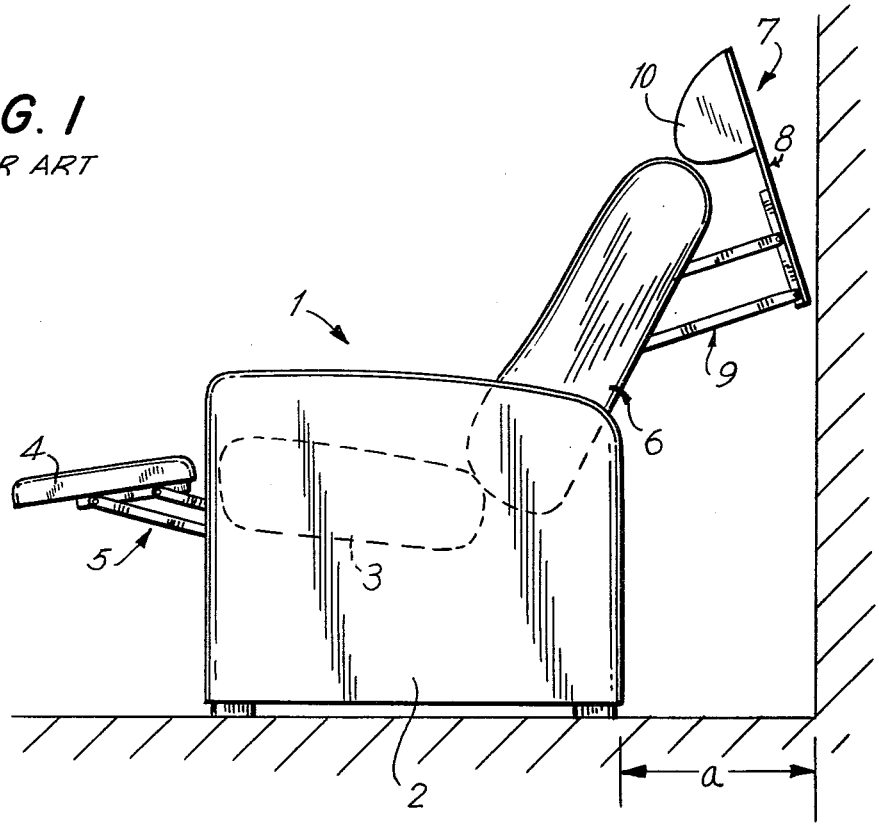
FIG. 1 PRIOR ART
FIG. 1 is a side elevational view of a reclining chair equipped with a conventional headrest arrangement.

Referring now to the drawing in detail, and first to FIG. 1 thereof, it may be seen that it depicts a conventional reclining chair, especially a wall-proximity reclining chair, which is generally identified by the reference numeral 1. The reclining chair 1 includes, as its basic components, a base 2, a seat 3 mounted on the base 2 in a conventional manner, a legrest 4 supported on and moved by a linkage 5 which is mounted on the base 2 as well, a backrest 6 which is mounted on the base 2 for movement between an upright position and a reclined position through a plurality of intermediate positions at least one of which can be considered to be a television-watching position, and a headrest arrangement 7. The chair 1 of FIG. 1 is shown in its partially reclined or television-watching position.

The headrest arrangement 7 of the conventional reclining chair 1 of FIG. 1 includes a support 8 which is mounted on the backrest 6 by means of a kinematic linkage 9, and a cushion member 10 which is affixed to the support 8 at the upper portion of the latter. It may be seen that in this conventional headrest arrangement construction, the cushion member 10 is just about flush with the plane of the backrest 6 in the illustrated extended position of the support 8, and yet the support 8 extends a considerable distance rearwardly of the base 2, which requires the positioning of the conventional reclining chair 1 at least at a distance a from the wall in order to avoid collision. In addition thereto, the reclining chair of FIG. 1 is aesthetically unappealing when viewed from the side, especially because of the clear visibility of the kinematic linkage 9 and its substantial projection behind the backrest 6. If it were attempted, in this conventional construction, to have the cushion member 10 extend frontwardly beyond the backrest 6 in the extended position of the support 8, the kinematic linkage 9 would have to be given even more extensive dimensions, so that it would have to extend even farther rearwardly of the backrest 6, thus making the side view of the chair 1 even less appealing and requiring a further increase in the distance a.

Figure 2:
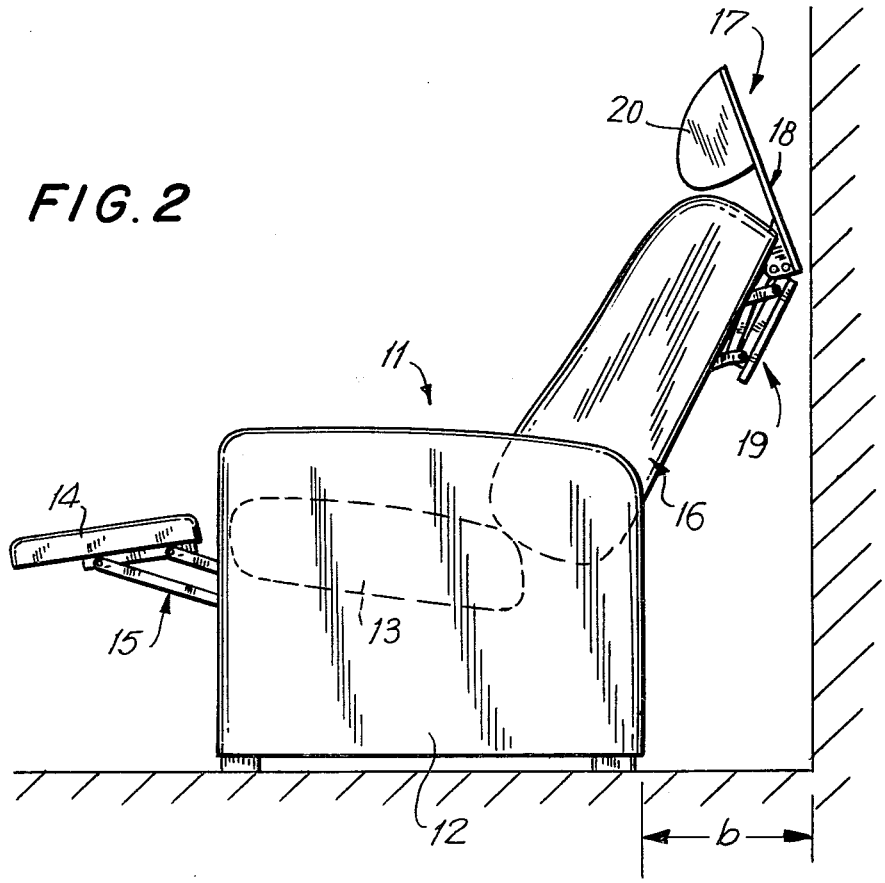
FIG. 2 is a view similar to FIG. 1 but showing the headrest arrangement of the present invention.

In contrast thereto, it may be seen in FIG. 2 where reference numerals raised by ten relative to those used in connection with FIG. 1 have been used to identify corresponding parts, that the chair 11 of the present invention, which also includes a base 12, a seat 13, a legrest 14, a linkage 15 for the legrest 14, a backrest 16, and a headrest arrangement 17, has a much more compact and hence much more aesthetically appealing appearance when viewed from the side. In addition thereto, because of the compact construction of the headrest arrangement 17, the reclining chair 11 can be placed at a distance b from the wall, the distance b being considerably smaller than the distance a. Yet, in the illustrated extended position of the headrest arrangement 17, a cushion member 20 which is mounted on the upper part of a support 18 which, in turn, is supported on a kinematic linkage 19, extends a considerable distance frontwardly beyond the plane of the backrest 16. All these advantageous features of the headrest arrangement according to the present invention are attributable to the construction of the support 18 and of the kinematic linkage 19, which will now be described in detail with reference to FIGS. 3 to 5.

Figure 3:
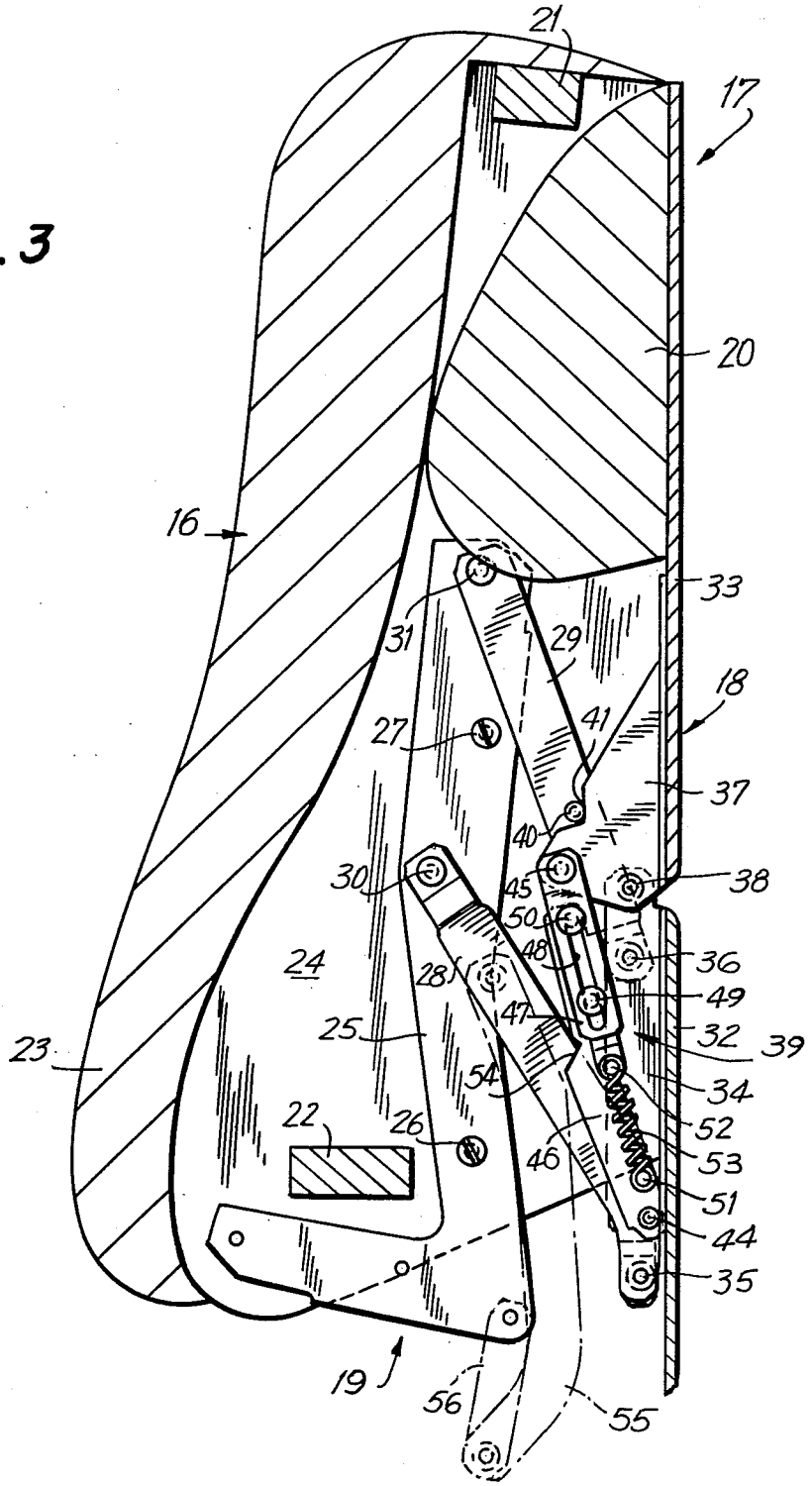
FIG. 3 is an enlarged sectional view through a backrest and the headrest arrangement of the reclining chair of FIG. 2, taken in a central plane of symmetry of the chair, the headrest arrangement being in its retracted position.

FIG. 3 illustrates the backrest 16, and the headrest arrangement 17 in its retracted position. The backrest 16 includes a frame of which two beams 21 and 22 are visible, and upholstery 23 which is so configurated as to bound a cavity 24. In the retracted position of FIG. 3, the support 18 extends across the open side of the cavity or recess 24, substantially along a single plane, so that the very existence of the headrest arrangement 17 is almost imperceptible to a casual observer. In this position, the support 18 conceals the contents of the cavity, which includes the cushion member 20 and the entire kinematic linkage 19.

The kinematic linkage 19 includes a stationary link 25 which is affixed to the backrest 16 in any conventional manner, such as by screws 26 and 27, and two mounting links 28 and 29 which are respectively pivotally mounted on the stationary link 25 by pivots 30 and 31. The support 18 includes two support parts or members, 32 and 33, of which the support part 32 includes a bracket 34 to which the mounting links 28 and 29 are articulated by respective pivots 35 and 36. Thus, the links 25, 28 and 29 and the bracket 34 together constitute a four-bar linkage .

The support members 32 and 33, which together constitute the support 18, are connected to one another for angular displacement relative to each other about a substantially horizontal axis. To this end, the support member 33 is provided with a bracket 37 which is pivotally connected to the bracket 34 of the support member 32 by means of a pivot 38. The bracket 37 and the kinematic linkage 19 are connected to one another by a connecting link 39 which will be described in more detail below in conjunction with FIG. 4. It may also be seen that the mounting link 29 carries a stop projection or pin 40 which, in the retracted position illustrated in FIG. 3, is received in an indentation 41 of the bracket 37 and abuts one of the surfaces bounding the indentation 41 to thereby delimit the range of movement of the headrest arrangement 17 toward the retracted position.

Figure 4:
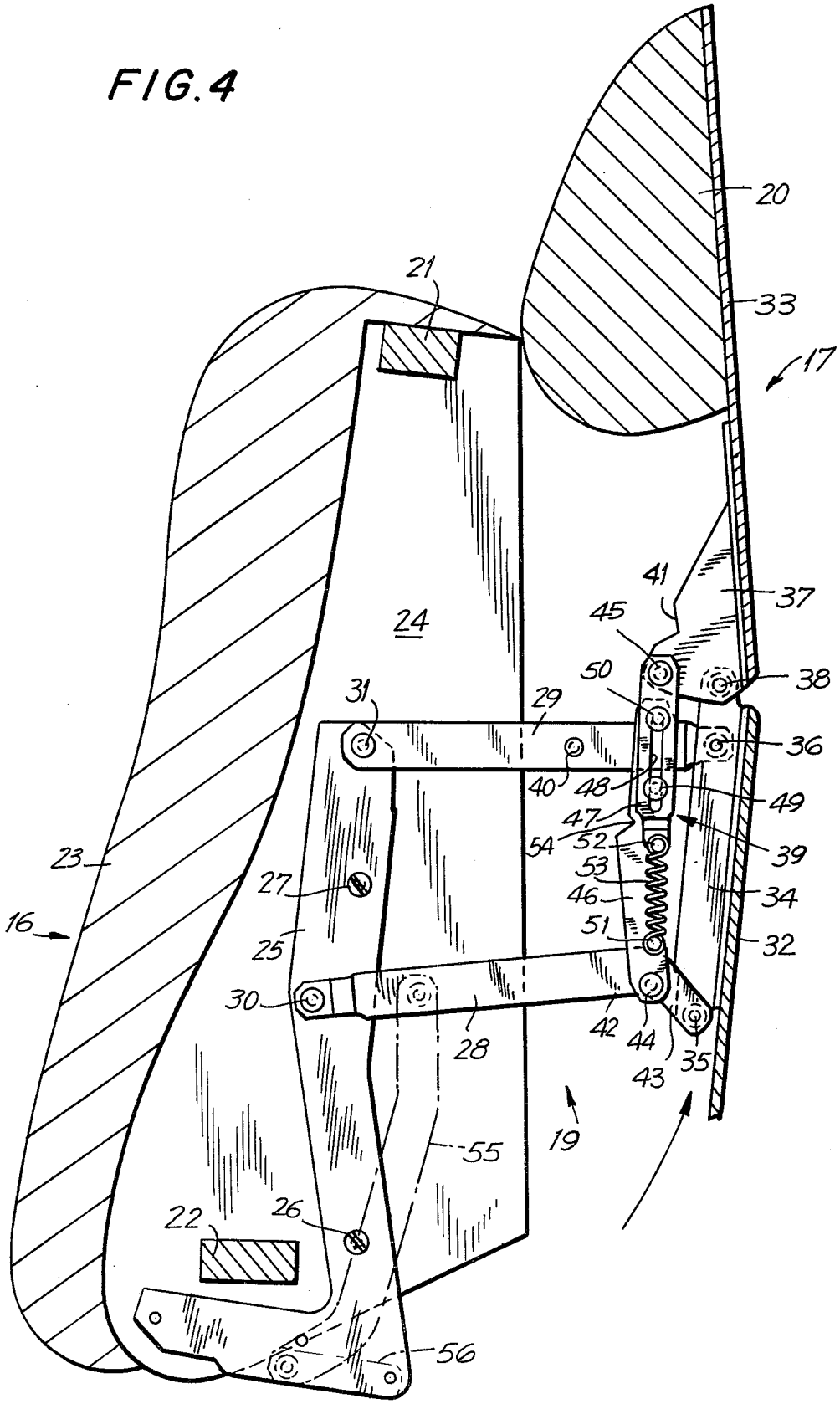
FIG. 4 is a view similar to FIG. 3 but with the headrest arrangement in its intermediate position.

Turning now to FIG. 4, which shows the headrest arrangement in an intermediate position between its retracted and extended positions, it may be seen that the mounting link 29 is substantially straight but that the mounting link 28 has two portions 42 and 43 which extend at an angle relative to one another. A pivot 44 arranged at the region of merger of the portions 42 and 43 of the mounting link 28 mounts one end of the connecting link 39 on the mounting link 28, while the other end of the connecting link 39 is pivotally mounted on the bracket 37 of the support member 33 by means of a pivot 45. In the position of FIG. 4, the cushion member 20 has just emerged from the cavity 24 and is moving past an upper portion of the upholstery 23, assuming movement in the direction of the arrow shown in FIG. 4 from the retracted position of FIG. 3 toward the extended position of FIG. 5. It may also be seen in FIG. 4 that the links 28 and 29 have slightly different effective lengths, that is, the distances between the axes of the pivots 30 and 35, on the one hand, and of the pivots 31 and 36, on the other hand. This, in conjunction with the angular configuration of the mounting link 28 and the longitudinal dimension of the connecting link 39, that is, the distance between the axes of the pivots 44 and 45, results in such movement of the headrest arrangement 17 that the cushion member 20 will just clear the upper portion of the upholstery 23 in the position of FIG. 4. During the movement of the headrest arrangement 17, the connecting link 39 will cause the bracket 37, and thus the support member 33, to change its angular position about the pivot 38 relative to the bracket 34 and the support member 32, this angular displacement being only slight between the positions of FIGS. 3 and 4, and considerably more pronounced between the positions of FIGS. 4 and 5.

FIG. 4 also shows that the connecting link 39 may be, and preferably is, so constructed that its longitudinal dimension can be varied. To achieve this, the connecting link 39 includes two elongated parts 46 and 47, of which the part 47 is provided with a longitudinally extending slot 48 which displaceably receives two guiding projections or pins 49 and 50 which are rigidly connected to the part 46 of the connecting link 39. Thus, the pins 49 and 50 will only allow movement of the parts 46 and 47 of the connecting link 39 relative to one another in the longitudinal direction of the slot 48. The pins 49 and 50 have respective stems which substantially fittingly pass through the slot 48, and enlarged heads which are situated at the opposite side of the part 47 from the part 46 of the connecting link 39 and thus prevent extraction of the respective pins 49 and 50 from the slot 48.

The part 46 carries a support pin 51, while the part 47 has a support pin 52 rigidly connected thereto. An extension spring 53 is mounted, at its two ends, on the respective support pins 51 and 52. The spring 53 is pre-tensioned to the desired extent during the assembly of the headrest arrangement 17, so that it will urge the parts 46 and 47 of the connecting links 39 toward, and usually maintain the same in, the illustrated relative end position in which the longitudinal dimension of the connecting link 39 is the shortest. However, it will be appreciated that, should the cushion encounter resistance during its movement past the upper portion of the upholstery 23, it will be able to yield with the support member 33, after overcoming the spring force of the spring 53. Yet, this possibility will usually be avoided since it would result in wear and tear of the cushion member 20 and/or of the upholstery 23.

Figure 5:
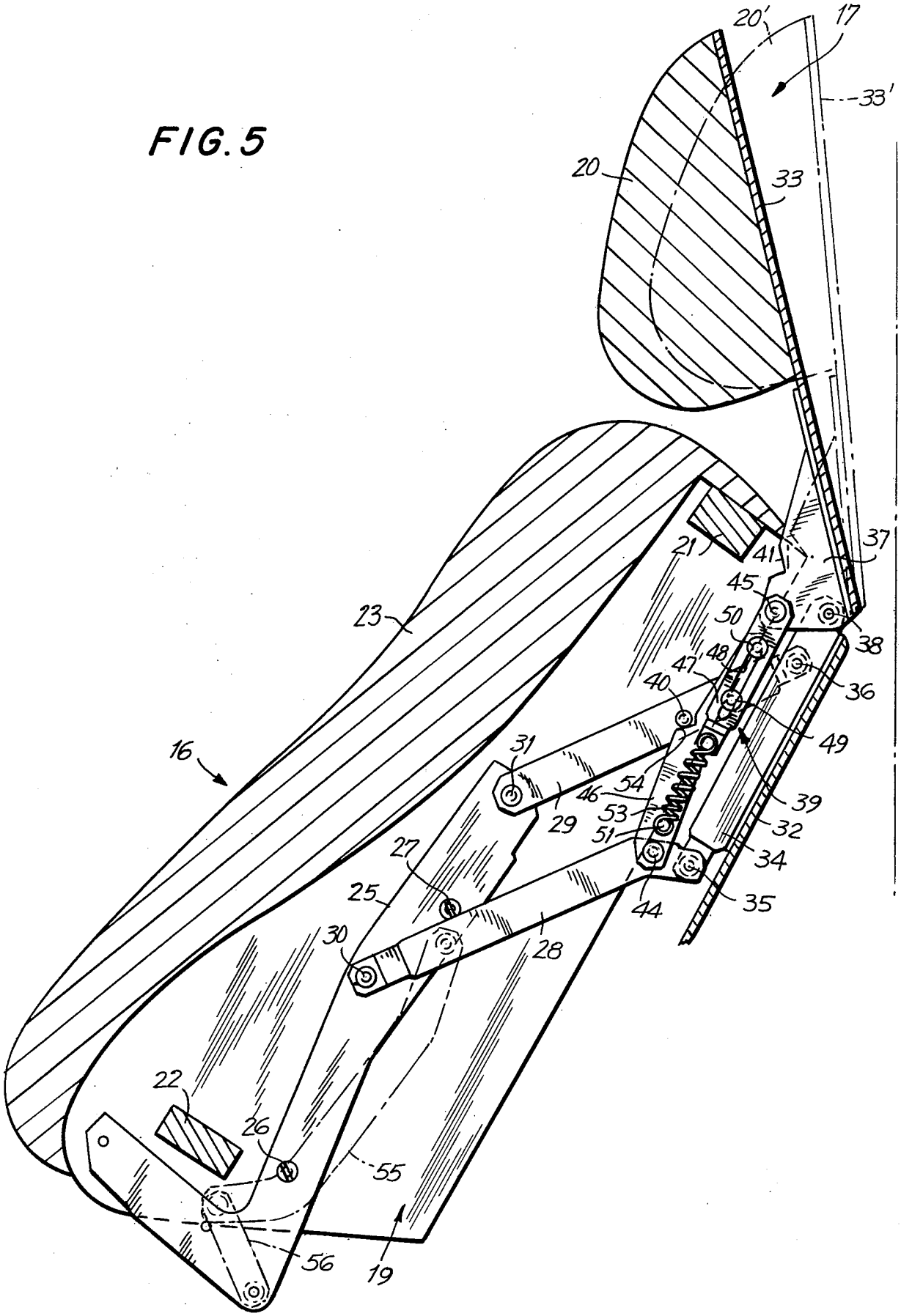
FIG. 5 is a view similar to FIG. 3 but with the backrest in its reclined position and with the headrest arrangement in its extended position.

The main purpose of making the connecting link 39 extendable will best be ascertained from FIG. 5 which shows the backrest in its reclined position and the headrest arrangement 17 in its extended position in which the cushion member 20 normally extends well beyond the upholstery 23 of the backrest 16 as considered in the frontward direction. This normal position of the cushion member 20 and of the support member 33 supporting the same is shown in FIG. 5 in solid lines. Then, it is shown in broken lines and indicated by the reference numerals supplemented by primes that the cushion member 20 and the support member 33 may be made to yield while the support member 32 remains stationary, to assume their respective positions 20′ and 33′. Thus, when the user of the chair rests his or her head on the cushion member 20, it will yield in proportion to the force exerted thereon, thus giving the user an additional feeling of comfort. The extent of yielding is delimited by the length of the slot 48 and the spacing between the pins 49 and 50, and is determined by the pre-tension and spring constant of the spring 53 and their relation to the force exerted on the cushion member 20 by the user.

As may also be seen in FIG. 5, in the extended position of the headrest arrangement 17 the pin 40 carried by the mounting link 29 abuts an abutment surface 54 provided on the part 46 of the connecting link 39, this abutment determining the extended position of the headrest arrangement 17 and preventing movement of the latter beyond this position.

FIGS. 3 to 5 also show an operating mechanism for the headrest arrangement 17, this mechanism including links 55 and 56 of which the link 55 is pivotally connected to the mounting link 28. The links 55, 56 are operatively connected in force-transmitting driving relationship to any convenient part of the chair linkage in order to drive the kinematic linkage and the support and cushion members between said retracted and extended positions. Since this operating mechanism is of a conventional construction not forming a part of the present invention, it has been shown only diagrammatically and in broken lines.

Figure 6:
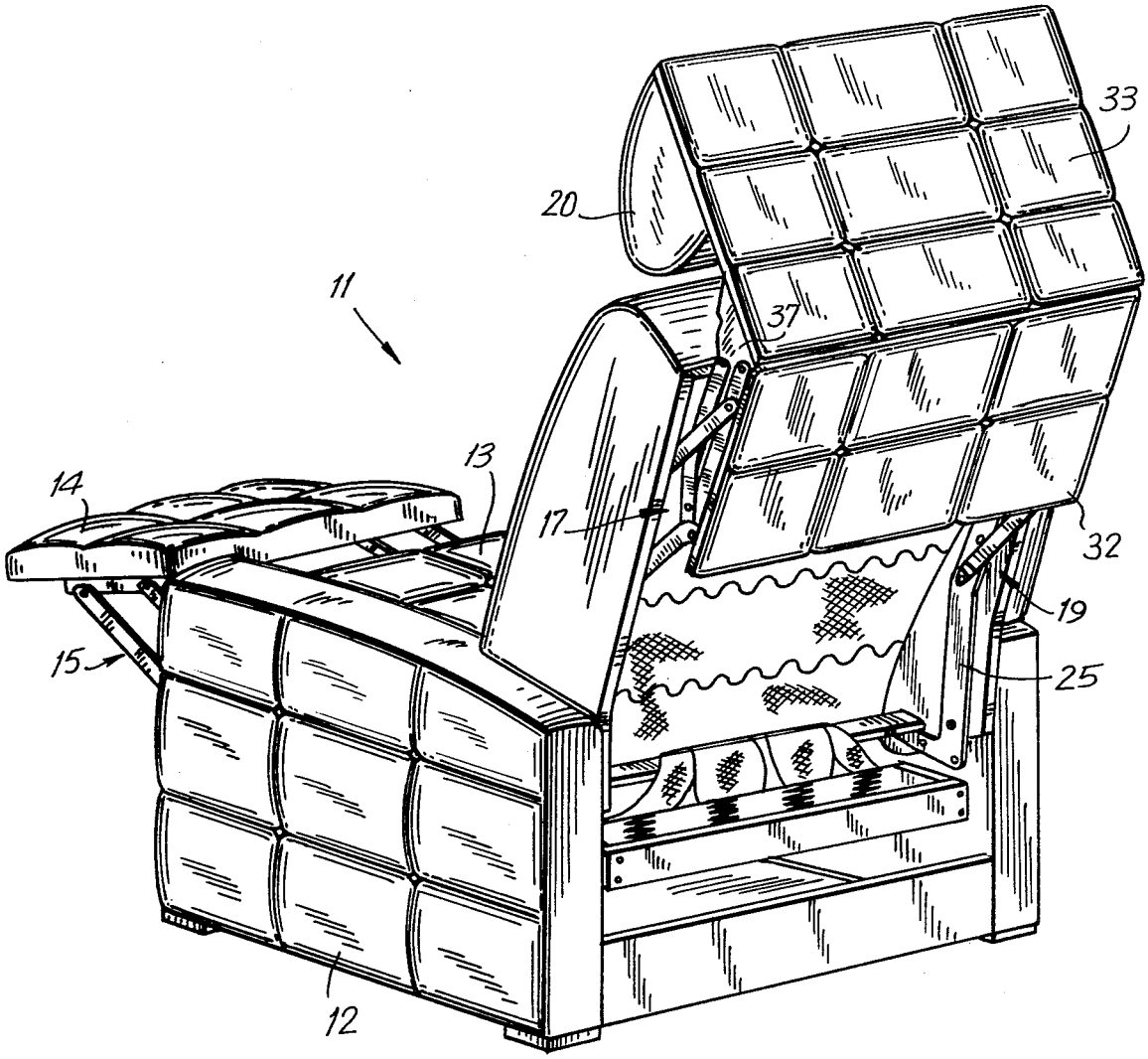
FIG. 6 is a rear perspective view of the reclining chair of FIG. 2 with the headrest arrangement in its extended position.

As may be seen in FIG. 6, the reclining chair 11 of the present invention has good enough an appearance that it could be used free-standing in the middle of the room when desired. Usually, however, the chair 11 will be positioned close to a wall.

It will be undestood that each of the elements described, or two or more together, may also find a useful application in other types of arrangements differing from the type described above.

While the invention has been illustrated and described as embodied in a wall-proximity reclining chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A headrest arrangement for use on a backrest of a chair, particularly of a reclining chair, comprising a support including a first and a second support member articulately connected to one another for angular displacement relative to each other about an axis disposed therebetween;

a cushion member secured at least to said first support member and projecting in a predetermined direction therefrom;

means for so mounting said support on the backrest that said first support member is situated upwardly of said second support member and said axis extends substantially horizontally for movement between a retracted position in which said support and cushion members are situated in the back of the backrest and an extended position in which at least said first support member extends upwardly of the backrest and said cushion member projects frontwardly above the backrest and beyond the same, said mounting means including at least one kinematic linkage mounting said second support member on the backrest;

means for angularly displacing said first support member relative to said second support member during the movement of said support relative to the backrest between said retracted and extended positions thereof, said angularly displacing means including at least one connecting link articulated to said kinematic linkage and to said first support member; and means for changing the effective length of said connecting link.

2. The headrest arrangement as defined in claim 1, wherein said mounting means includes at least one kinematic linkage mounting said second support member on the backrest; and wherein said angularly displacing means includes at least one connecting link articulated to said kinematic linkage and to said first support member.

3. The headrest arrangement as defined in claim 2, wherein said first support member includes a main element and at least one bracket secured to said main element and projecting in said predetermined direction therefrom; and wherein said connecting link is articulately mounted on said bracket.

4. The headrest arrangement as defined in claim 3, wherein said kinematic linkage includes at least two mounting links extending between the backrest and said second support member; and wherein said connecting link is articulately mounted on one of said mounting links.

5. The headrest arrangement as defined in claim 4, wherein said one mounting link is more remote from said first support member than the other mounting link.

6. The headrest arrangement as defined in claim 5 for use on a backrest having a recess for accommodating said cushion member in said retracted position of said support and at least a part of said kinematic linkage at all times, wherein said support members, said kinematic linkage, and said connecting link are so constructed that said support members extend, in continuation of one another, across the open end of the recess to conceal the same and the contents thereof, in said retracted position.

7. The headrest arrangement as defined in claim 6 for use in a wall-proximity reclining chair, wherein said support and cushion members, said kinematic linkage, and said connecting link are so constructed that said support members move in close proximity of the back side of the backrest during their movement between said retracted and extended positions.

8. The headrest arrangement as defined in claim 7, wherein said mounting links have different effective lengths.

9. The headrest arrangement as defined in claim 8, wherein said kinematic linkage is a four-bar linkage in which said mounting links extend substantially parallel to one another in all positions of said support.

10. The headrest arrangement as defined in claim 9, and further comprising a stop member on the other of said mounting links, and an abutment surface on said bracket against which said stop member abuts in said retracted position of said support.

11. The headrest arrangement as defined in claim 10, and further comprising an additional abutment surface on said connecting link against which said stop member abuts in said extended position of said support.

12. The headrest arrangement as defined in claim 1, wherein said connecting link includes two elongated parts; and wherein said changing means includes means for mounting said parts of said connecting link on one another for movement relative to each other longitudinally thereof between two end positions, and means for urging said parts to one of said end positions.

13. The headrest arrangement as defined in claim 12, wherein said means for mounting said parts of said link on one another includes an elongated slot in one of said parts, and at least one projection on the other of said parts received in said slot for movement longitudinally thereof.

14. The headrest arrangement as defined in claim 13, wherein said projection has a stem received in said slot, and a head enlarged relative to said slot and situated at the other side of said one part from said other part of said connecting link to prevent extraction of said stem from said slot.

15. The headrest arrangement as defined in claim 14, wherein said means for mounting said parts of said connecting link on one another further includes another projection similar to said projection of said other part and spaced therefrom in the longitudinal direction of said slot to restrict the movement of said parts to longitudinally of said slot.

16. The headrest arrangement as defined in claim 15, wherein said urging means comprises at least one spring connected to said one part at one of its ends and to said other part at its other end and urging said parts toward that of said end positions thereof in which the effective length of said connecting link is the shortest.

17. The headrest arrangement as defined in claim 16, wherein said spring is pre-tensioned to hold said parts of said connecting link in said one end position thereof.

18. The headrest arrangement as defined in claim 17, wherein the pretensioning force of said spring is such that said cushion and first support member will yield only when the pressure exerted thereon by the head of the user exceeds a preset value.

19. A headrest arrangement for use on a backrest of a reclining chair, comprising a support including a first movable support member and a second movable support member articulately connected to one another for angular displacement relative to each other;

a cushion member secured at least to said first support member and projecting in a predetermined direction therefrom;

means for mounting both of said support members on the backrest for movement relative thereto in response to the reclining of the chair between a retracted position in which said support members and said cushion member are situated in the back of the backrest, and an extended position in which said support members and said cushion member have been raised such that said cushion member is situated upwardly of the backrest; and means for angularly displacing said first support member and said cushion member secured thereon relative to said second support member during the movement of said support members and said cushion member relative to the backrest such that said cushion member projects frontwardly above the backrest and beyond the same in said extended position.

20. The headrest arrangement as defined in claim 19, wherein said support members are articulately connected for relative angular displacement about an axis disposed therebetween, and wherein said support members are so mounted on the backrest that said first support member is situated upwardly of said second support member, and said axis extends substantially horizontally.

* * * * *